US010363179B2

(12) United States Patent
Itano

(10) Patent No.: US 10,363,179 B2
(45) Date of Patent: Jul. 30, 2019

(54) WHEELCHAIR INCLUDING ACCOMMODATION POCKET

(71) Applicant: SWANY CORPORATION, Kagawa (JP)

(72) Inventor: Tsukasa Itano, Higashikagawa (JP)

(73) Assignee: SWANY CORPORATION, Kagawa (JP)

( * ) Notice: Subject to any disclaimer, the term of this patent is extended or adjusted under 35 U.S.C. 154(b) by 8 days.

(21) Appl. No.: 15/464,618

(22) Filed: Mar. 21, 2017

(65) Prior Publication Data

US 2017/0273839 A1 Sep. 28, 2017

(30) Foreign Application Priority Data

Mar. 24, 2016 (JP) ..... 2016-060894

(51) Int. Cl.
*A61G 5/10* (2006.01)
*A61G 5/12* (2006.01)
*A61G 5/02* (2006.01)

(52) U.S. Cl.
CPC ..... *A61G 5/10* (2013.01); *A61G 5/02* (2013.01); *A61G 5/1094* (2016.11); *A61G 5/125* (2016.11)

(58) Field of Classification Search
CPC ..... A61G 5/10; A61G 5/125; A61G 5/1094; A61G 5/02
USPC ..... 280/250.1
See application file for complete search history.

(56) References Cited

U.S. PATENT DOCUMENTS 4,730,869 A * 3/1988 Schumacher ..... A61G 5/10 280/304.1
5,154,331 A * 10/1992 Sanders ..... A61G 5/10 224/275
5,263,728 A * 11/1993 Patel ..... A61G 5/0825 280/250.1
6,375,209 B1 * 4/2002 Schlangen ..... A61G 5/045 180/907
7,334,712 B2 * 2/2008 Hassett ..... A44B 19/262 224/268
7,845,667 B2 * 12/2010 Mahler ..... A61G 5/10 224/282
2011/0233890 A1 * 9/2011 Jutkiewicz ..... A61G 5/10 280/202

(Continued)

FOREIGN PATENT DOCUMENTS

JP 2007-82794 4/2007

*Primary Examiner* — Jacob D Knutson
(74) *Attorney, Agent, or Firm* — Wenderoth, Lind & Ponack, L.L.P.

(57) ABSTRACT

A wheelchair is provided includes driving wheels, a pair of side frames, and an accommodation pocket. The frames rotatably support the driving wheels coupled to the exterior sides of the side frames. Each of side frames includes an elbow rest frame portion, a vertical frame portion, and a lower frame portion. The elbow rest frame portion has an elbow rest. The vertical frame portion is coupled to the rear end part of the elbow rest frame portion. The lower frame portion is arranged under the elbow rest frame portion. The vertical frame portion is coupled to the rear end part of the lower frame portion. The accommodation pocket is arranged above the front part of the driving wheel as viewed in side view, and is at least partially positioned on the exterior side relative to the elbow rest frame portion as viewed in front view.

14 Claims, 13 Drawing Sheets

(56) References Cited

U.S. PATENT DOCUMENTS

| | | | | |
|---|---|---|---|---|
| 2012/0292879 | A1* | 11/2012 | Ferniany | A61G 5/14<br>280/250.1 |
| 2014/0166711 | A1* | 6/2014 | Mitchell | A61G 5/10<br>224/407 |

* cited by examiner

WHEELCHAIR INCLUDING ACCOMMODATION POCKET

CROSS-REFERENCE TO RELATED APPLICATIONS

The present application claims priority under 35 U. S. C. § 119 to Japanese Patent Application No. 2016-060,894, filed Mar. 24, 2016. The contents of this application are incorporated herein by reference in their entirety.

BACKGROUND OF THE INVENTION

1. Field of the Invention

The present invention relates to a wheelchair including an accommodation pocket.

2. Description of the Related Art

Traditional wheelchairs do not include a part for accommodating user's things. Users of wheelchairs prepare shoulder, hand or shopping bags, or the like, and hold the bags on their laps with their money, valuables, small articles, and the like. They also tie handles of straps of their bags around a front or side frame part of wheelchairs. However, such a bag is unstable on user's lap. The user should have a care not to drop the bag. In particular, when the user rotates the driving wheels with user's hands to move the wheelchair, the bag is likely to fall from user's lap. In the case where such a bag is tied to a front or side frame part of wheelchairs, the user has to lean forward or turns user's body in order to pick up user's things from the bag. This is inconvenient for mobility-impaired users.

A baggage holder 100 is known which is addressed to this and can be attached to the main frame of a wheelchair (Japanese Laid-Open Patent Publication No. JP 2007-82,794 A). A wheelchair shown in FIG. 13 can hold a baggage box 127 on the baggage holders 100 attached to its main frames.

However, since the baggage holder disclosed in JP 2007-82,794 A is also attached to the front frame, the user is required to lean user's body forward when picking up user's things. That is, conventional wheelchairs have no accommodation portion which allows users to easily pick up their things in the sitting posture. Also, since the baggage box 127 disclosed in JP 2007-82,794 A extends between the right and left side frames, it is too large to directly accommodate small articles. Accordingly, the user will put small article into bags, and place the bag in the baggage box 127. For this reason, it is inconvenient for the user to put/pick user's things into/up from the bag in the box. In addition, when the user collapses the wheelchair in the right-and-left direction, the baggage holders 127 will obstruct the collapsing operation. For this reason, the user has to detach the baggage holders 127 from the wheelchair when required to collapse the wheelchair. In recent years, smart phones and tablet PCs become popular. Correspondingly, users will more frequently pick up these devices, and the like from their bags. For this reason, there is a need of a wheelchair which has an accommodation portion to allow users to easily pick up their things in the sitting posture.

The present invention is devised to solve the above problems. It is one of the objects of the present invention to provide a wheelchair which includes an accommodation portion to allow users to easily pick up their things and put them back.

SUMMARY OF THE INVENTION

A wheelchair according to a first aspect of the present invention includes driving wheels, a pair of side frames, and an accommodation pocket. The side frames rotatably support the driving wheels coupled to the exterior sides of the side frames. Each of side frames includes an elbow rest frame portion, a vertical frame portion, and a lower frame portion. The elbow rest frame portion has an elbow rest. The vertical frame portion is coupled to the rear end part of the elbow rest frame portion. The lower frame portion is arranged under the elbow rest frame portion. The vertical frame portion is coupled to the rear end part of the lower frame portion. The accommodation pocket is arranged above the front part of the driving wheel as viewed in side view, and is at least partially positioned on the exterior side relative to the elbow rest frame portion as viewed in front view.

Since this wheelchair has the accommodation pocket is provided, the users can easily put their things into the accommodation pocket and pick up them. According to this wheelchair, the space above the front part of the driving wheel can be effectively used for the accommodation pocket.

In addition, in a wheelchair according to a second aspect of the present invention, each of the side frames further includes a middle frame portion that is positioned between the elbow rest frame portion and the lower frame portion. The vertical frame is coupled to the rear end of the middle frame portion. The accommodation pocket is arranged between the elbow rest frame portion and the middle frame portion.

According to this wheelchair, the space between the elbow rest frame portion and the middle frame portion can be effectively used for the accommodation pocket. Also, since the accommodation pocket is positioned under the elbow rest frame portion and above the driving wheel, the users can easily put their things into the accommodation pocket and pick up them while sitting down.

In addition, in a wheelchair according to a third aspect of the present invention, the accommodation pocket is at least partially arranged immediately under the elbow rest frame portion.

According to this wheelchair, the space immediately under the elbow rest frame portion can be effectively used for the accommodation pocket.

In addition, in a wheelchair according to a fourth aspect of the present invention, the accommodation pocket is arranged on the exterior side relative to the point of one of the right and left elbow rest frame portions which is the closest to another elbow rest frame portion.

According to this wheelchair, since the accommodation pocket is arranged on the exterior side relative to the closest point between the elbow rest frame portions, reduction of the seat space can be prevented when the accommodation pocket is provided while the space immediately under the elbow rest frame portion can be effectively used for the accommodation pocket.

In addition, in a wheelchair according to a fifth aspect of the present invention, the accommodation pocket includes a pocket front portion, a pocket rear portion, and a bottom plate. The pocket front portion defines the front part of the accommodation pocket. The pocket rear portion is located on the rear side relative to the pocket front portion. The bottom plate closes the bottom side of the accommodation pocket. The bottom plate has a curved surface in the pocket rear portion that extends along the outer periphery of the driving wheel so that the accommodation pocket is arranged close to and at least partially overlaps the upper part of the driving wheel.

According to this wheelchair, the space above the driving wheel can be effectively used. Also, since the accommodation pocket is arranged close to a part of the upper part of the driving wheel whereby covering this part, the accommodation pocket can serve as a tire cover which effectively prevents users' arms or sleeves from contacting the tire.

In addition, in a wheelchair according to a sixth aspect of the present invention, the pocket front portion has a roughly rectangular parallelepiped shape.

According to this wheelchair, since the pocket front portion has a roughly rectangular parallelepiped shape, the space above the front part of the driving wheel can be effectively used.

In addition, a wheelchair according to a seventh aspect of the present invention further includes a panel that at least partially closes the gap between the elbow rest frame portion and the middle frame portion. The accommodation pocket is coupled to the panel.

According to this wheelchair, since panel can close the gap between the elbow rest frame portion and the middle frame portion, the users can be prevented from unintended contact with the driving wheel. Also, since the accommodation pocket is designed to be attached to the panel, the accommodation pocket can be easily provided to the wheelchair by simply attaching the accommodation pocket to the panel.

In addition, in a wheelchair according to an eighth aspect of the present invention, the accommodation pocket is formed of a plate-shaped material. The accommodation pocket has an interior-side plate, which is the plate-shaped material and defines the interior side of the accommodation pocket. The interior-side plate is integrally formed with the panel.

According to this wheelchair, since the interior-side plate is integrally formed with the panel, the thickness of the interior-side plate can be reduced or eliminated. Correspondingly, the capacity of the accommodation pocket can be increased.

In addition, a wheelchair according to a ninth aspect of the present invention further includes an attachment portion that can attach the accommodation pocket to the panel. The attachment portion includes first and second attachment parts. The first attachment part is arranged on the panel. The second attachment part is arranged at the position of the accommodation pocket corresponding to the first attachment part. The second attachment part has a shape for detachable attachment to the first attachment part so that the accommodation pocket can be detachably attached to the panel by the attachment portion.

According to this wheelchair, the accommodation pocket can be easily attached/detached to/from the panel by the attachment portion.

In addition, in a wheelchair according to a tenth aspect of the present invention, the panel includes a panel coupling portion which is coupled to the side frame. The panel coupling portion includes a lateral coupling part that extends perpendicularly to the panel toward the interior or exterior side of the wheelchair from an end of the panel whereby forming an L shape in the end of the panel.

According to this wheelchair, the lateral coupling part can lie in a plane perpendicular to the side frame, and the panel can be coupled to the wheelchair through the lateral coupling part. Also, in the case where the lateral coupling part is directly coupled to the side frame, the space immediately under the elbow rest frame portion can be effectively used for a part of the accommodation pocket. Also, when coupled to the side frame, the panel can be easily positioned with respect to the side frame by the lateral coupling part. Also, the mechanical strength of the panel can be improved by forming a lateral part as the panel coupling portion in the panel.

In addition, in a wheelchair according to an eleventh aspect of the present invention, the side frame further includes an interlinking frame portion that is coupled to end parts of the elbow rest frame portion and the middle frame portion which are opposite to their rear ends coupled to the vertical frame portion. Front-side and rear-side lateral coupling parts are provided as the lateral coupling part. The front-side lateral coupling part is arranged on the front side of the panel, and is in contact with and fastened to the interlinking frame portion. The rear-side lateral coupling part is arranged on the rear side of the panel, and is in contact with and fastened to the vertical frame portion.

According to this wheelchair, since two parts (front-side and rear-side parts) of the panel are coupled to the side frame, the panel can be stably fastened to the side frame.

In addition, in a wheelchair according to a twelfth aspect of the present invention, the vertical frame portion and the interlinking frame portion extend along different roughly vertical lines at different horizontal positions as viewed in front view. The front-side and rear-side lateral coupling parts extend in opposite directions from the panel. The panel extends parallel to the vertical plane of the side frame.

According to this wheelchair, in the case where the vertical frame portion and the interlinking frame portion extend along different roughly vertical lines at different horizontal positions, the front-side and rear-side lateral coupling parts which extend in opposite directions allow the panel to extend parallel to the vertical plane of the side frame.

In addition, in a wheelchair according to a thirteenth aspect of the present invention, the panel coupling portion includes a longitudinal coupling part that extends in the fore-and-aft direction from the lateral coupling part, and is in contact with and fastened to the exterior or interior surface of the side frame.

According to this wheelchair, in addition to a surface perpendicular (orthogonal) to the side frame, the panel can be fastened to the exterior-side or interior-side surface of the side frame. As a result, the panel can be more firmly fastened to the side frame. Also, even in the case where the accommodation pocket and the front-side lateral coupling part are not spaced at a sufficiently gap away from each other, when it is difficult to place a fastener, which is used to fasten the panel to the side frame, into the gap between the accommodation pocket and the front-side lateral coupling part, the panel can be fastened through the longitudinal coupling part to the side frame.

In addition, a wheelchair according to a fourteenth aspect of the present invention further includes grip rings that are arranged on the exterior surfaces of the driving wheels. The accommodation pocket has an exterior-side plate, which is a plate-shaped material and defines the exterior side of the accommodation pocket. The exterior-side plate is arranged on the interior side relative to the grip ring.

According to this wheelchair, the width of the wheelchair can be small. As a result, the users can easily move the wheelchair on even a narrow way.

In addition, in a wheelchair according to a fifteenth aspect of the present invention, the side frame further includes an interlinking frame portion that is coupled to end parts of the elbow rest frame portion and the middle frame portion which are opposite to their rear ends coupled to the vertical frame portion. Additionally, the wheelchair further includes footrest arms, and footrest plates. The footrest arms can pivot in the fore-and-aft direction between a forward position and a rearward position. In the forward position, the fore ends of the footrest arms are positioned on the front side relative to the side frames. In the rearward position, the fore ends of the footrest arms are positioned between the middle frame portion and the elbow rest frame portion. The base end parts of the footrest arms are pivotably coupled to the exterior surfaces of the front part of the side frames. The footrest plates are pivotably coupled to the fore end parts of the footrest arms so that the footrest plates are pivotable between an unfolded position and a folded position. In the unfolded position, the footrest plates can support user's feet. In the folded position, the upper surfaces of the footrest plates face the footrest arms. Footrest plate accommodation space is provided on the front side relative to the interlinking frame portion between the elbow rest frame portion and the middle frame portion. The accommodation pocket is arranged on the rear side relative to the interlinking frame portion, which is opposite to the footrest plate accommodation space with respect to the interlinking frame portion.

According to this wheelchair, although the accommodation pocket is provided, the footrest plates can be accommodated in the footrest plate accommodation space. That is, since the footrest plate accommodation space for the footrest plate is provided on the front side relative to the interlinking frame portion, the footrest plate can be accommodated by pivoting the footrest arm rearward without interference between the footrest plate and the accommodation pocket, which is provided on the rear side relative to the interlinking frame portion.

In addition, a wheelchair according to a sixteenth aspect of the present invention further includes a foldable link that couples the side frames to each other, and can guide the translational movement of the side frames approaching each other when the wheelchair is collapsed.

According to this wheelchair, the accommodation pocket does not obstruct the translational movement of the side frames which is guided by the structure for collapsing the wheelchair. In other words, since the accommodation pocket is arranged on the exterior side relative to the closest point between the elbow rest frame portions, even in the translational movement of the side frames approaching each other when the wheelchair is collapsed, the accommodation pocket does not obstruct the translational movement of the side frames.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
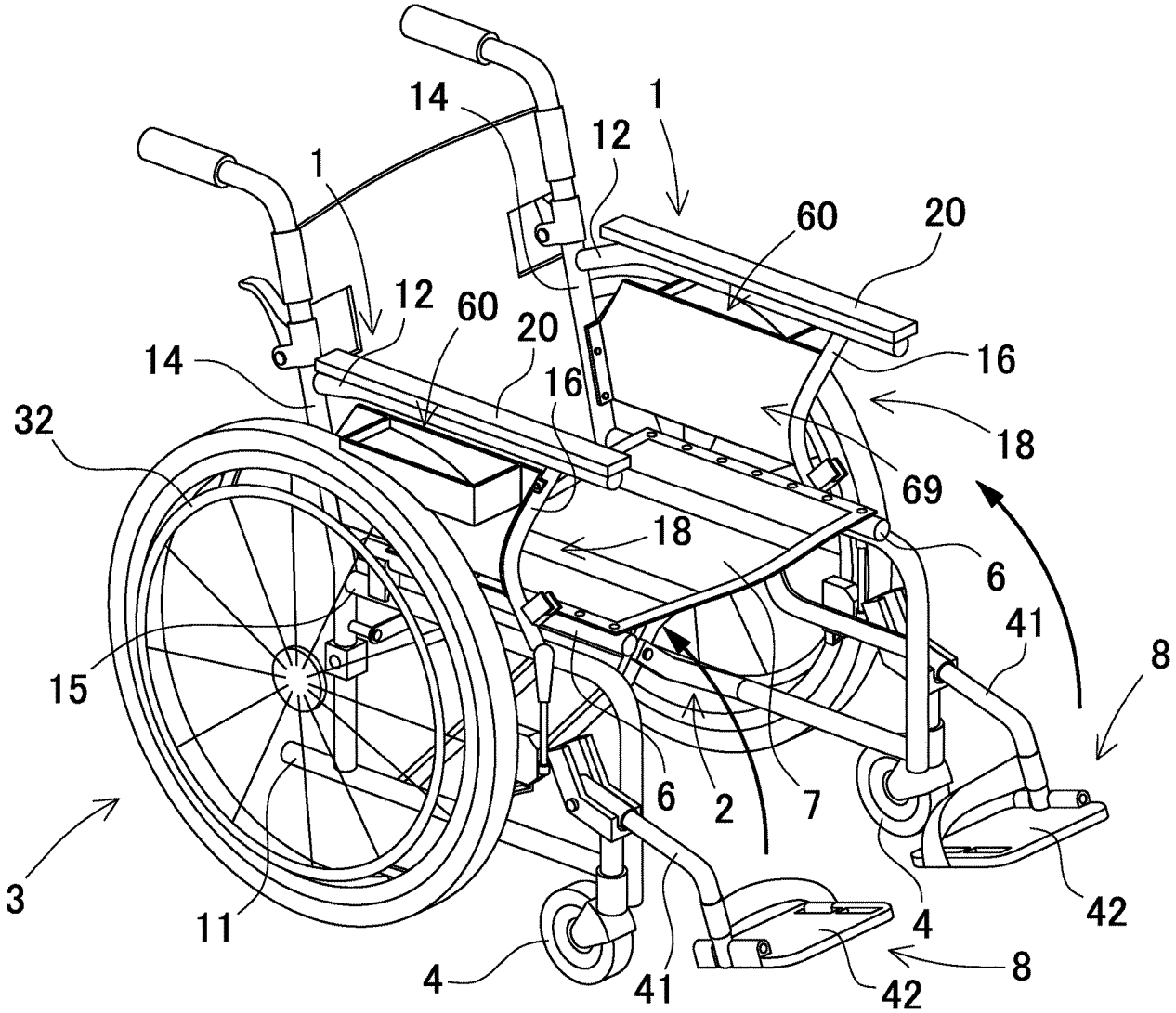
FIG. 1 is a perspective view of a wheelchair according to an embodiment of the present invention.

The embodiments will now be described with reference to the accompanying drawings, wherein like reference numerals designate corresponding or identical elements throughout the various drawings.

It should be appreciated, however, that the embodiments described below are illustrations of a wheelchair to give a concrete form to technical ideas of the invention, and a wheelchair of the invention is not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown exaggeratingly for ease of explanation. Members same as or similar to those of this invention are attached with the same designation and the same reference numerals and their description is omitted. In addition, a plurality of structural elements of the present invention may be configured as a single part that serves the purpose of a plurality of elements, on the other hand, a single structural element may be configured as a plurality of parts that serve the purpose of a single element.

In this specification, the term "the space above the front part of a/the driving wheel" refers to the space which lies out of the wheel on the front side relative to a vertical line which passes through the center of the driving wheel, and on the upper side relative to a horizontal line which passes through the center of the driving wheel as viewed in side view. The term "a/the accommodation pocket is positioned above a/the driving wheel" refers that the accommodation pocket partially overlaps the driving wheel as viewed in plan view.

First Embodiment

A wheelchair according to a first embodiment includes accommodation pockets that can accommodate user's things. The wheelchair shown in a perspective view of FIG. 1 includes driving wheels 3, a pair of side frames 1, a foldable link 2, seat frames 6, a flexible seat 7, casters 4, and footrests 8. The driving wheels 3 are coupled to the exterior sides of the side frames 1. The side frames 1 are coupled to the bottom ends of the foldable link 2. The seat frames 6 are coupled to the top ends of the foldable link 2. The flexible seat 7 is coupled to the seat frames 6. The casters 4 are coupled to the front parts of the side frames 1, and are free to swivel in the horizontal direction. The footrests 8 are coupled to the side frames 1. The grip rings 32 are fixed to the exterior sides of the driving wheels 3. The user can rotate the driving wheels 3 through the grip rings 32. Each of the footrests 8 includes a footrest plate 42 that supports user's foot on its upper surface in a horizontal position, and a footrest arm 41 that is coupled to the side frame 1. The footrest plate 42 is coupled to the footrest arm 41.

(Side Frames 1)

Figure 2:
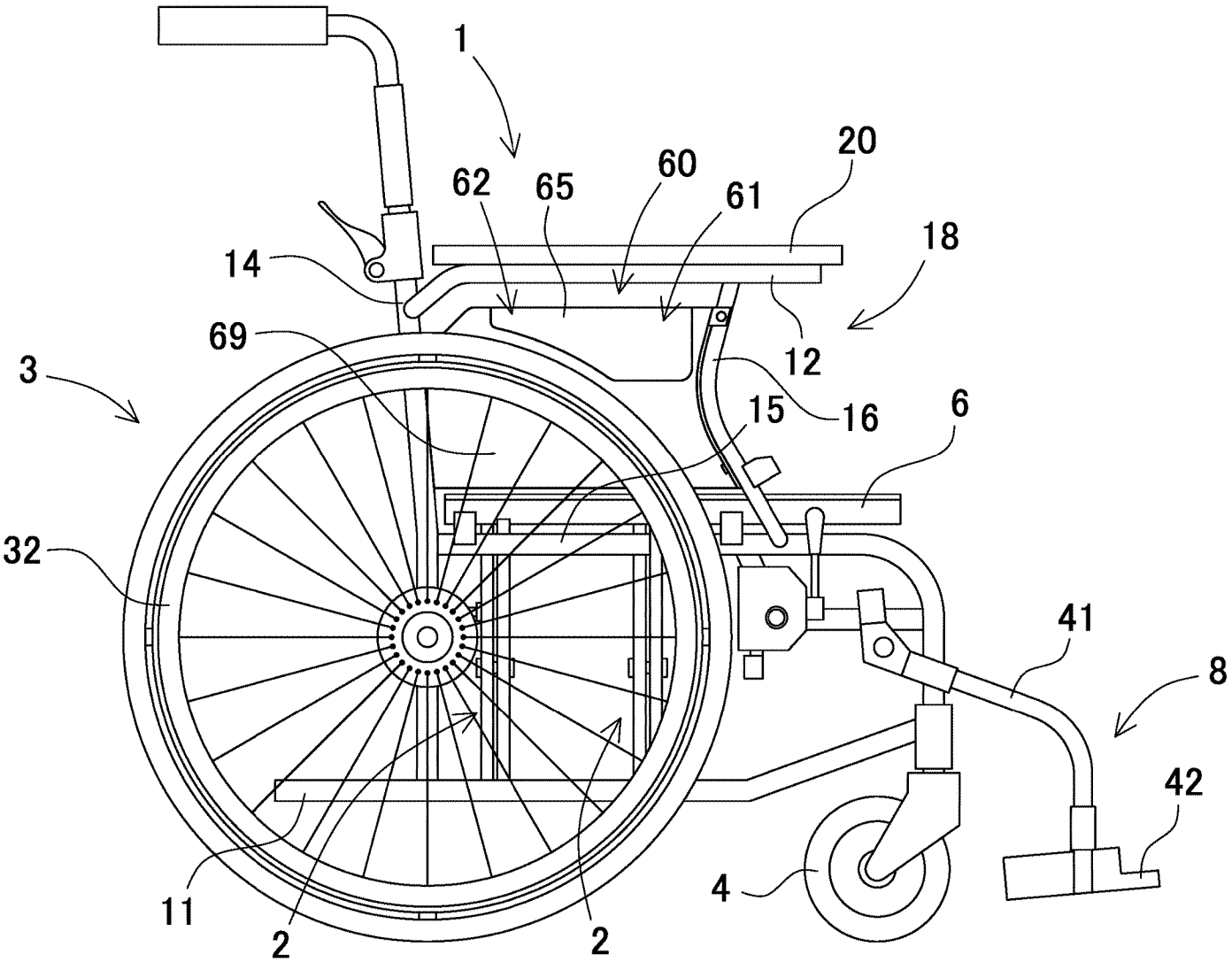
FIG. 2 is a side view of the wheelchair shown in FIG. 1.

FIG. 2 is a side view of the wheelchair of FIG. 1. Each of the side frames 1 of the wheelchair shown in FIG. 2 includes an elbow rest frame portion 12, a vertical frame portion 14, and a bottom frame portion 11. The elbow rest frame portion 12 extends in the horizontal direction. An elbow rest 20 is arranged on the upper surface of the elbow rest frame portion 12. The vertical frame portion 14 is coupled to the rear end part of the elbow rest frame portion 12. The bottom frame portion 11 extends in the horizontal position, and is coupled to the lower end part of the vertical frame portion 14. Middle frame portions 15 are arranged between the elbow rest frame portions 12 and the lower frame portions 11, and extend in the horizontal direction. The rear ends of the middle frame portions 15 are coupled to the vertical frame portions 14. In the wheelchair shown in FIG. 2, interlinking frame portions 16 are provided which are coupled to the end parts of the elbow rest frame portions 12 and the middle frame portion 15 which are opposite to their rear ends, which are coupled to the vertical frame portion 14. The upper end of the interlinking frame portion 16 is coupled to the point of the elbow rest frame portion 12 which is spaced at a distance away from the fore end of the elbow rest frame portion 12. The lower end of the interlinking frame portion 16 is coupled to the point of the middle frame portion 15 which is spaced at a distance away from the front part of the middle frame portion 15. Footrest plate accommodation space 18 is provided on the front side relative to the interlinking frame portion 16 between the elbow rest frame portion 12 and the middle frame portion 15. The footrest plate 42 can be held in the footrest plate accommodation space 18. The interlinking frame portion 16 of the side frame 1 has a curved form which bulges rearward in its central part. Accordingly, the footrest plate accommodation space 18 can be large.

Figure 3:
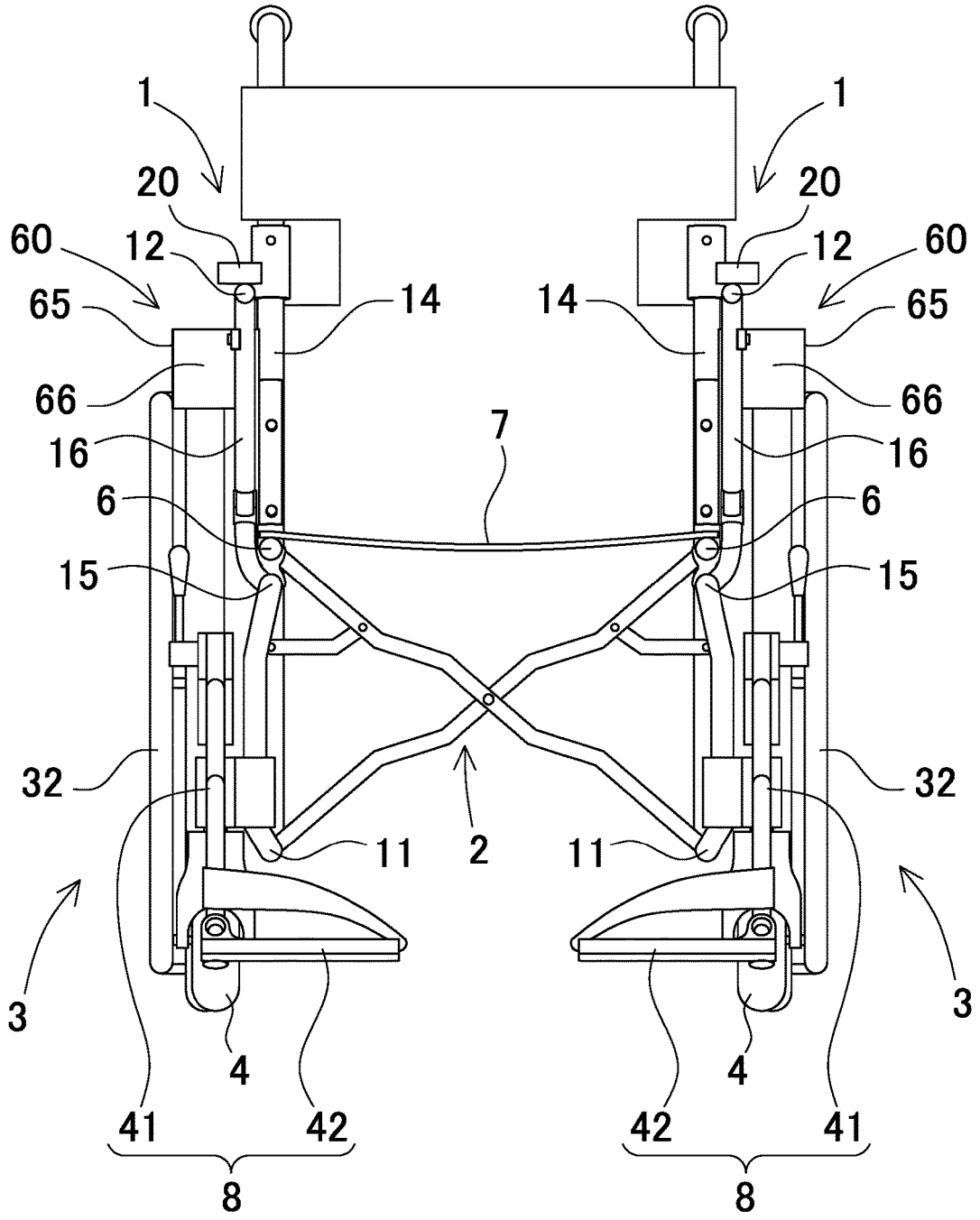
FIG. 3 is a front view of the wheelchair shown in FIG. 1.

FIG. 3 is a front view of the wheelchair of FIG. 1. As shown in FIG. 3, the side frames 1 are coupled to each other by the foldable link 2. As shown in FIG. 3, the upper ends of the foldable link 2 are coupled to the seat frames 6, and the lower ends of the foldable link 2 are coupled to the bottom frame portions 11. The right and left side frames 1 can be used as a single frame by coupling the side frames 1 to each other by the foldable link 2.

(Elbow Rest Frame Portion 12)

As shown in FIG. 1 and FIG. 3, the rear end parts of the elbow rest frame portions 12 of the side frames 1 are bent inward, and the front end parts of the elbow rest frame portions 12 are positioned on the exterior side relative to the rear end parts of the elbow rest frame portions 12. According to this arrangement, the wheelchair can provide large seat space between the right and left elbow rest frame portions 12.

(Middle Frame Portion 15)

The middle frame portion 15 has a straight shape as shown in FIGS. 1 and 3. Also, the middle frame portion 15 is positioned in the same vertical plane as the vertical frame portion 14 as shown in FIG. 3. The seat frames 6 are positioned above and parallel to the middle frame portions 15. The middle frame portion 15 includes a support portion that supports the seat frame 6 above the middle frame portion 15.

(Interlinking Frame Portion 16)

The lower end part of the interlinking frame portion 16 is bent inward as shown in FIG. 3. One end of the interlinking frame portion 16 is coupled to the front part of the middle frame portion 15, and another end is coupled to the front end part of the elbow rest frame portion 12, which is positioned on the exterior side relative to the middle frame portion 15. Since the bent shape of the interlinking frame portion 16 allows the lower part portion of the interlinking frame portion 16 to pass the exterior side of the seat frame 6 and then extend to the middle frame portion 15 from the exterior side of the middle frame portion 15, the interlinking frame portion 16 of the side frame 1 can be provided without interference with the seat frame 6, which is arranged above the middle frame portion 15.

(Footrest 8)

Figure 4:
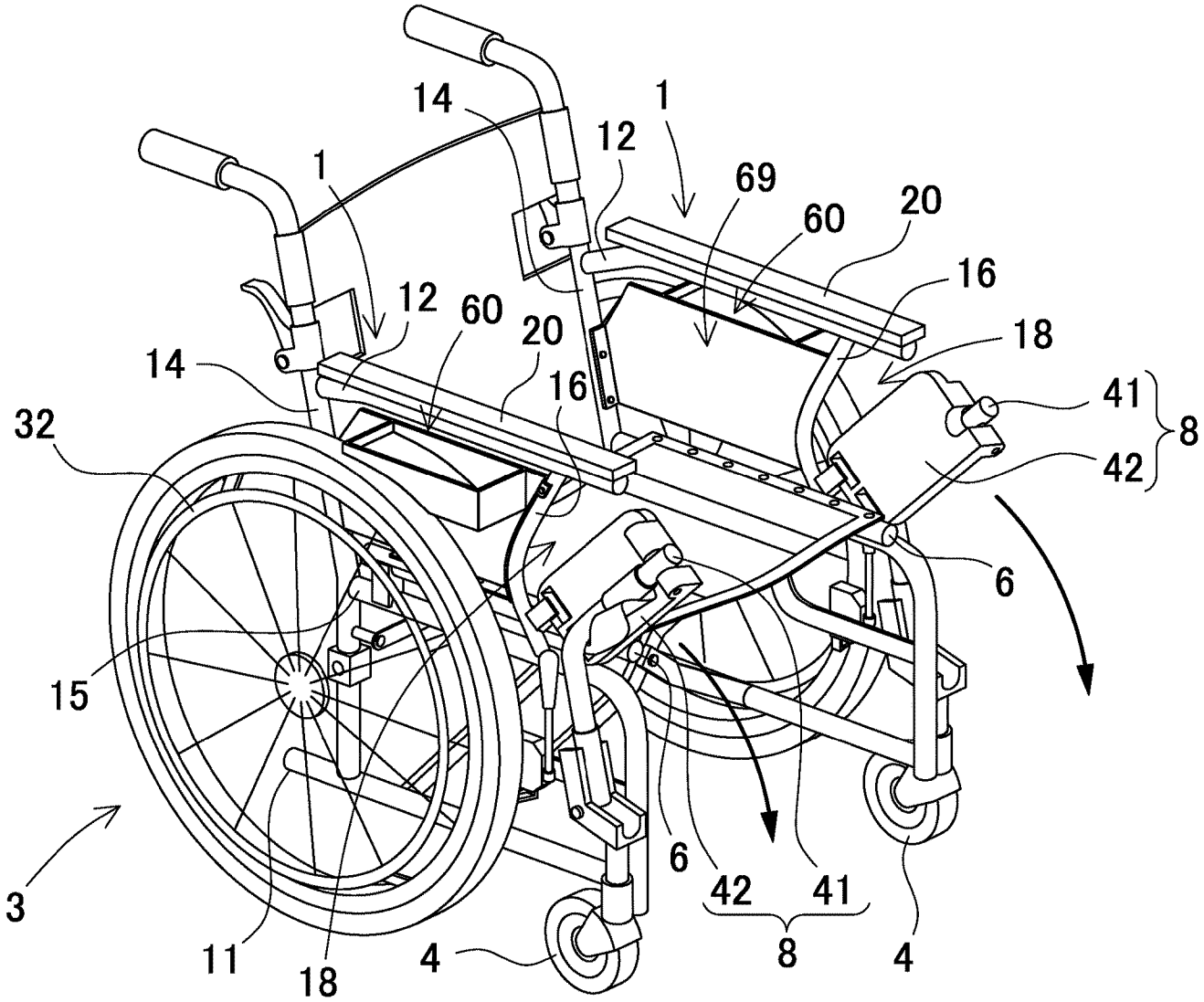
FIG. 4 is a perspective view showing the wheelchair shown in FIG. 1 with footrests being folded.

The footrest 8 of the wheelchair shown in FIG. 1 includes the footrest arm 41, which can pivot in the fore-and-aft direction between forward and rearward positions. In the forward position, the fore end of the footrest arm 41 is positioned on the front side relative to the side frame 1. In the rearward position, the fore end of footrest arm 41 is positioned between the middle frame portion 15 and the elbow rest frame portion 12. The rear end part of the footrest arm 41 is pivotably coupled to the exterior surfaces of the front part of the side frame 1. In addition, the footrest 8 includes the footrest plate 42, which is pivotably coupled to the fore end part of the footrest arm 41. The footrest plate 42 is pivotable between unfolded and folded positions. In the unfolded position, the footrest plate 42 can support user's foot. In the folded position, the upper surface of the footrest plate 42 faces the footrest arm 41. When the footrest 8 is folded by the rearward pivot movement of the footrest arm 41, the footrest can prevent interference with something outside the wheelchair in storage, or the like. FIG. 4 is a perspective view showing the wheelchair shown in FIG. 1 with its footrest arms being positioned in the rearward (folded) position. In the wheelchair, after the footrest plate 42 is folded so that its upper surface contacts the footrest arm 41, the footrest 8 can be folded by the rearward pivot movement of the footrest arm 41.

(Footrest Plate Accommodation Space 18)

The footrest plate accommodation space 18 is provided on the front side relative to the interlinking frame portion 16 between the elbow rest frame portion 12 and the middle frame portion 15. The footrest plate accommodation space 18 serves as space for accommodating the footrest plate 42. According to this construction of this wheelchair, the footrest plate 42 can be held in the footrest plate accommodation space 18 when folded as shown in FIG. 4. The interlinking frame portion 16 of the wheelchair has a curved form which bulges rearward, in other words, its central part is positioned on the rear side relative to the straight line between its upper and lower ends. Accordingly, the footrest plate 42 does not interfere with the interlinking frame portion 16 when the footrest 8 is accommodated in footrest plate accommodation space 18. As a result, the folding movement of the footrest 8 is not obstructed. According to this construction of this wheelchair, the footrest plate 42 can be held in the footrest plate accommodation space 18 when the footrest 8 is folded as shown in FIG. 4.

Although the aforementioned wheelchair has been described which includes the foldable footrest 8, the footrest 8 does not necessarily has a foldable mechanism. In the case where the footrest is not foldable, the footrest plate accommodation space 18 is not required. In this case, the interlinking frame portion 16 may have not a curved form which bulges rearward but a straight form. In the case where the wheelchair includes a modified straight interlinking frame portion 16, the space between the vertical frame portion 14 and the interlinking frame portion 16 can be large so that the area of the accommodation pocket 60 can be large.

(Foldable Link 2)

Figure 5:
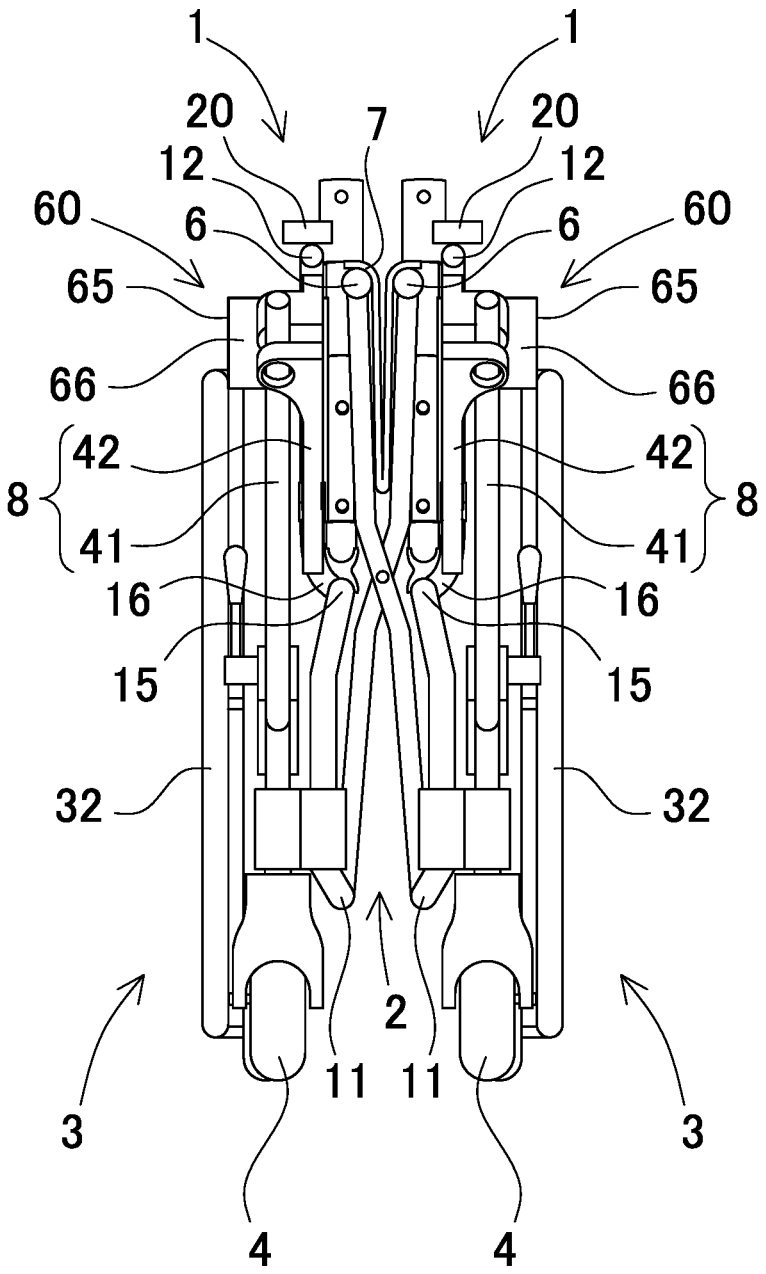
FIG. 5 is a front view showing the collapsed wheelchair shown in FIG. 1.

The wheelchair can be collapsed by the foldable link 2, which couples the side frames 1 to each other, and can guide the translational movement of the side frames 1 approaching each other. The foldable link 2 shown in the front view of FIG. 3 is an X-shaped link constructed of two metal rods. The central parts of the metal rods of the foldable link 2 are rotatably coupled to each other. The upper ends of the foldable link 2 are coupled to the seat frames 6, and the lower ends of the foldable link 2 are coupled to the bottom frame portions 11. FIG. 5 is a front view showing the collapsed wheelchair. This wheelchair can be collapsed by the translational movement of the side frames guided by the foldable link as shown in FIG. 5.

To collapse the wheelchair, the footrests 8 of the wheelchair are first folded as shown in FIG. 4. Subsequently, the seat frames 6, which are coupled to the foldable link 2, are moved upward. This upward movement of the seat frames 6 can rotate the metal rods of the foldable link 2 so that the upper ends approach each other, and the lower ends approach each other. Following further upward movement of the seat frames 6, the side frames 1, which are coupled to the foldable link 2, are moved inward. Finally, the wheelchair is collapsed with the right and left side frames 1 being arranged close to each other as shown in FIG. 5.

However, the wheelchair does not necessarily have such a collapsible mechanism. The foldable link 2 may be omitted to simplify the structure of the wheelchair.

(Accommodation Pocket 60)

Figure 6:
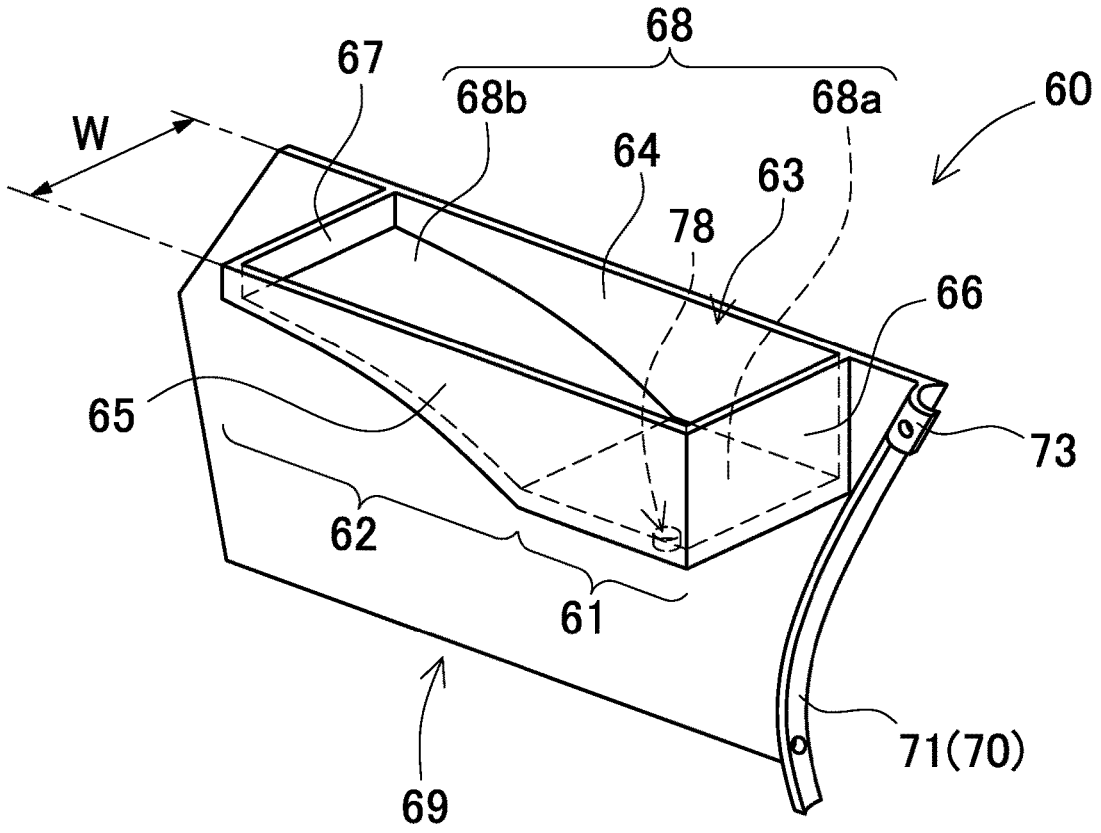
FIG. 6 is a perspective view of an accommodation pocket according to the embodiment of the present invention.
Figure 7:
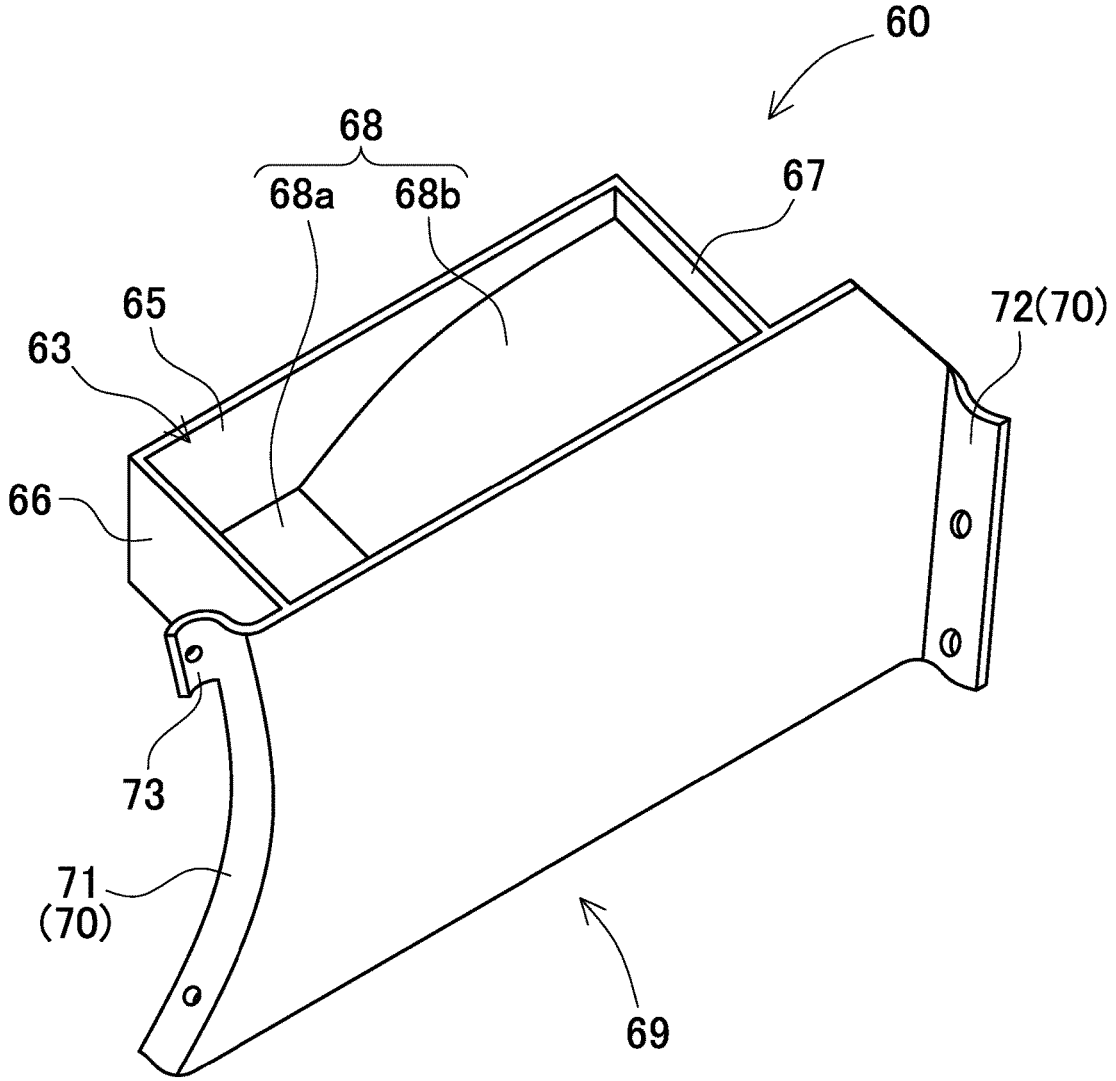
FIG. 7 is a perspective view of the accommodation pocket shown in FIG. 6 as viewed from another view point.
Figure 8:
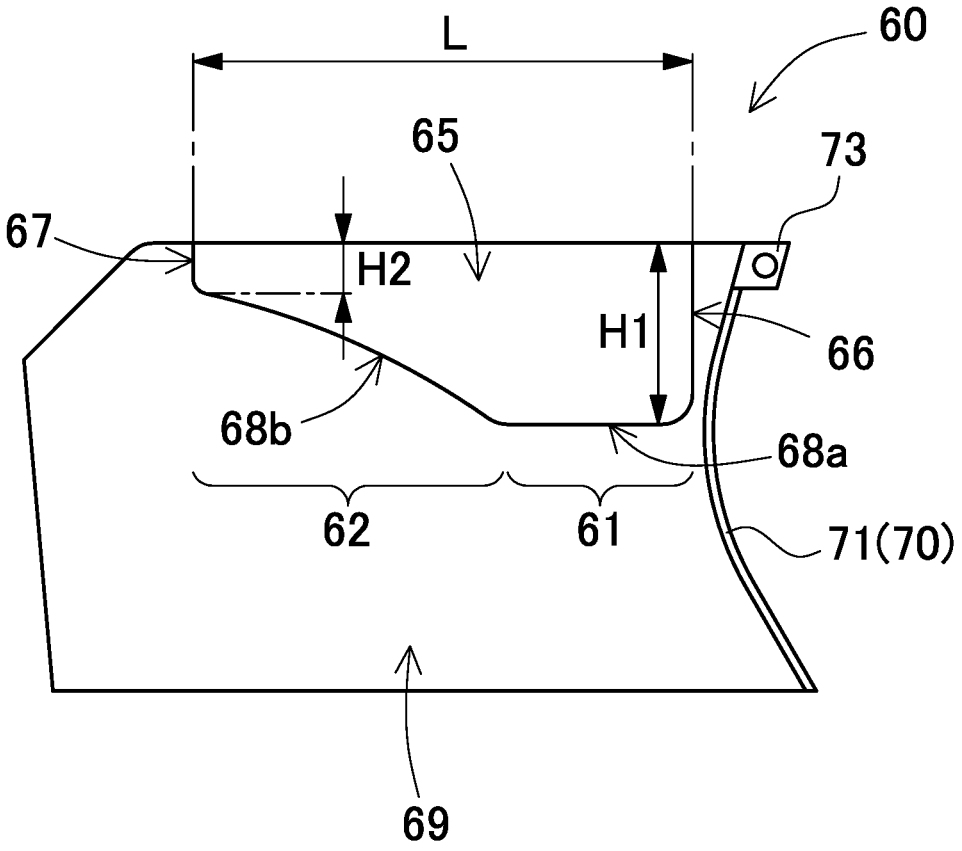
FIG. 8 is a side view of the accommodation pocket shown in FIG. 6.

The accommodation pockets 60 of the wheelchair shown in FIG. 1 are arranged on the exterior side of the side frames 1, and serve as holders which allow the user to easily pick up user's things and put them back while sitting down. The accommodation pocket 60 is formed of a resin material. FIG. 6 is a perspective view showing the accommodation pocket 60. FIG. 7 is a perspective view of the accommodation pocket shown in the perspective view of FIG. 6 as viewed from another view point. FIG. 8 is a side view of the accommodation pocket shown in FIG. 6. The accommodation pocket 60 shown in FIGS. 6 to 8 is formed in a box which is defined by a plate-shaped material, and has an opening 63 opened upward. The user can pick up user's things from the accommodation pocket 60 through the opening 63, and put them back. The accommodation pocket 60 shown in FIG. 6 includes an interior-side plate 64, an exterior-side plate 65, a front-side plate 66, and a rear-side plate 67 which are formed of a plate-shaped material. The bottom of the accommodation pocket 60 shown in FIG. 6, which is opposed to the opening 63, is closed by a bottom plate 68 which is the plate-shaped material and is coupled to the bottom edges of the interior-side plate 64, the exterior-side plate 65, the front-side plate 66 and the rear-side plate 67. When the accommodation pocket 60 is attached to the wheelchair, the interior-side plate 64 faces the side frame 1. The exterior-side plate 65 is opposed to the interior-side plate 64, and faces outward when the accommodation pocket 60 is attached to the wheelchair. The front-side plate 66 is coupled to the front-side edges of the interior-side and exterior-side plates 64 and 65. The rear-side plate 67 is coupled to the rear-side edges of the interior-side and exterior-side plates 64 and 65. The material of the accommodation pocket 60 is not limited to resin, but may be other material such as metal. The interior-side plate 64, the exterior-side plate 65, the front-side plate 66, and the rear-side plate 67 of the accommodation pocket 60 shown in FIG. 6 to FIG. 8 are flat plates. However, they are not limited to flat plates. They may have other shape such as a curved shape. Alternatively, the corners of them may be rounded. Also, some of the interior-side plate, the exterior-side plate, the front-side plate, the rear-side plate, and the bottom plate may form a continuous curved surface, in other words, two or more of these plates may form one continuous curved plate. In the case where the corner of the accommodation pocket is rounded, the safety of the wheelchair can be improved.

(Attachment Position of Accommodation Pocket 60)

The accommodation pocket 60 is positioned above the front part of the driving wheel 3 as viewed in the side view of the wheelchair as shown in FIG. 2. The accommodation pocket 60 is positioned on the exterior side relative to the elbow rest frame portion 12 as viewed in the front view of the wheelchair as shown in FIG. 3. According to this arrangement, the wheelchair can have the accommodation pocket 60, without reducing the seat space where the user sits on while effectively using the space above the front part of the driving wheel 3 as the accommodation pocket 60. Since the accommodation pocket 60 is positioned on the exterior side relative to the elbow rest frame portion 12, the right and left accommodation pockets 60 will not interfere with each other nor other members of the wheelchair when the wheelchair is collapsed, that is, the accommodation pockets 60 will not obstruct the collapsing movement of wheelchair.

The opening 63 of the accommodation pocket 60 is positioned on the lower side relative to the elbow rest frame portion 12 as shown in FIG. 2. According to this arrangement, the user can place user's arms outside the elbow rests 20 without interfere with the accommodation pockets 60.

Preferably, the accommodation pockets 60 are arranged at portions accessible to the user when sitting down. In this case, the user has neither to lean forward nor to turn user's body when picking up user's things from the accommodation pocket 60 and putting them back. For example, in the wheelchair shown in FIG. 2, the accommodation pocket 60 is arranged between the elbow rest frame portion 12 and the middle frame portion 15.

Figure 9:
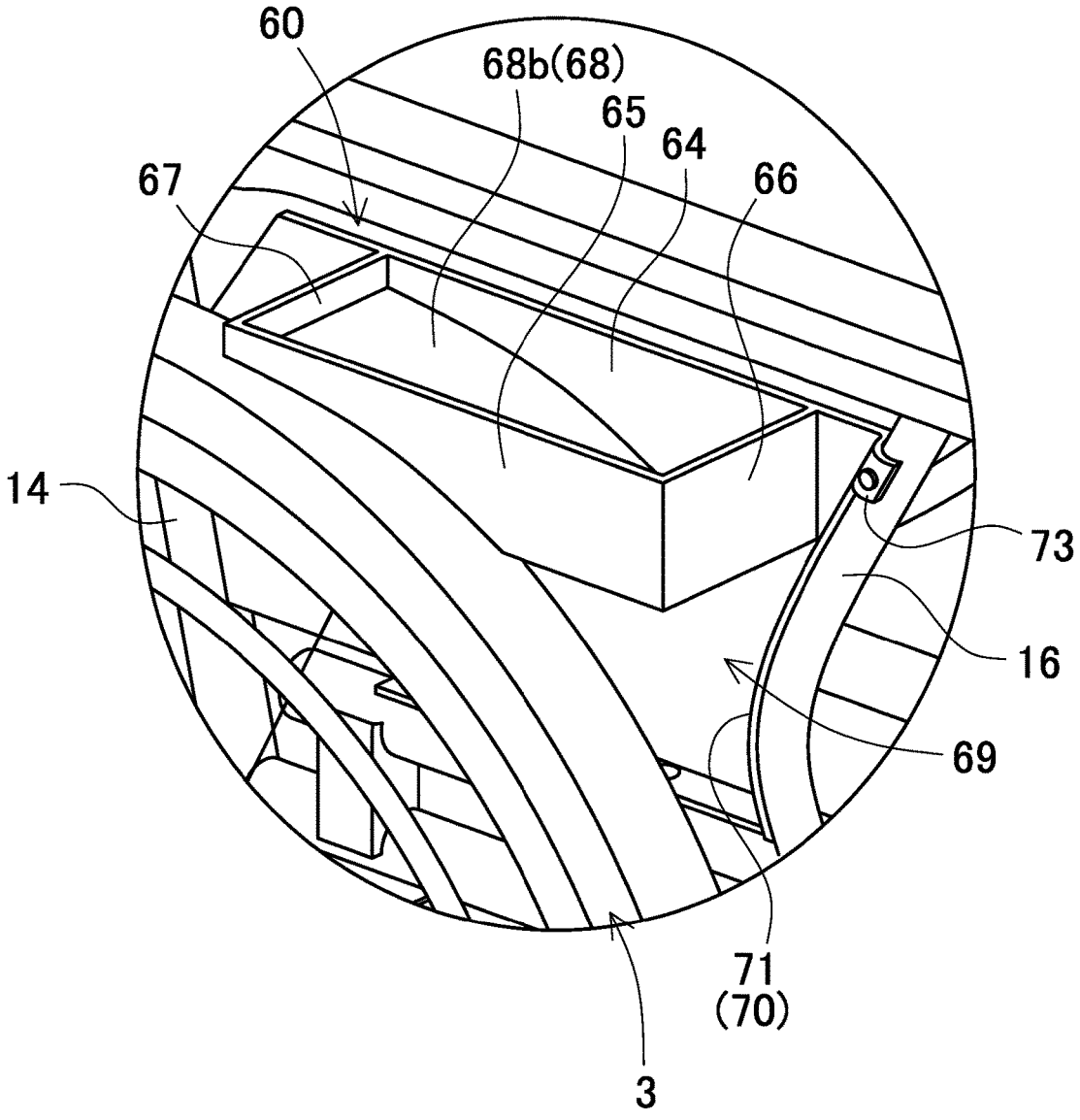
FIG. 9 is a perspective view showing the wheelchair with the accommodation pocket shown in FIG. 6 from the exterior side of the wheelchair.

FIG. 9 is a perspective view showing the accommodation pocket 60, which is attached to the side frame, from the exterior side of the wheelchair. The accommodation pocket 60 continuously extends from the outside of the elbow rest frame portion 12 to immediately under the elbow rest frame portion 12 so that a part of the accommodation pocket 60 is arranged immediately under the elbow rest frame portion 12. According to this arrangement, the space immediately under the elbow rest frame portion 12 can be effectively used for the accommodation pocket 60. The accommodation pocket 60 is preferably arranged on the exterior side relative to the point of one of the right and left elbow rest frame portions 12 which is the closest to another elbow rest frame portion. According to this arrangement, the seat space of the wheelchair is not reduced by the accommodation pocket 60 while the space immediately under the elbow rest frame portion 12 is effectively used.

The front end of the accommodation pocket 60 shown in FIG. 2 is positioned behind the interlinking frame portion 16. Since the front end of the accommodation pocket 60 is not located away too much from the user, the user can access user's things without leaning forward or turning user's body. In the wheelchair, the accommodation pocket 60 is positioned on the rear side relative to the interlinking frame portion 16, which is opposite to the footrest plate accommodation space 18 with respect to the interlinking frame portion 16. According to this arrangement, the footrest plate 42 of the wheelchair can be accommodated into the footrest plate accommodation space 18 without interference between the accommodation pocket 60 and the footrest plate 42 when the footrest arm 41 pivots rearward.

The rear end of the accommodation pocket 60 shown in FIG. 2 is positioned in front of the vertical frame portion 14. The rear end of the accommodation pocket 60 is preferably positioned on the front side relative to the vertical line that passes through the center of the driving wheel 3. In this case, since the rear end of the accommodation pocket 60 is positioned on the front side relative to the center of the driving wheel 3, the rear-side plate 67 can have a sufficient height to prevent articles from falling out of the accommodation pocket 60 over the rear-side plate 67. However, the rear end of the accommodation pocket may be positioned on the rear side relative to the vertical line that passes through the center of the driving wheel 3. In this case, for example, a care worker, or the like who moves the wheelchair from the rear side can put articles into the accommodation pocket.

Also, it is preferable that the exterior-side plate 65 of the accommodation pocket 60 is positioned on the interior side relative to the grip ring 32, which is fixed to the exterior side of the driving wheel 3 as shown in FIGS. 3 and 5. In the case where the accommodation pocket 60 is positioned on the interior side relative to the grip ring 32 of the driving wheel 3, the width of the wheelchair can be small to allow the user to easily move the wheelchair on even a narrow way, and the wheelchair can be compact when collapsed. In addition, the user can grasp the grip rings 32 without interference by the accommodation pockets 60 to user's hands or arms.

(Geometry of Accommodation Pocket 60)

The dimensions of the accommodation pocket 60 shown in FIGS. 6 and 8 can be determined depending on the type of wheelchair, such as the distance between the elbow rest frame portion 12 and the middle frame portion 15, and the diameter of the driving wheel 3. For example, the size of the accommodation pocket 60 can be small in the case of small wheelchairs for children. The size of the accommodation pocket 60 can be large in the case of large wheelchairs for adults. For example, in the geometry of the accommodation pocket 60, the length L in the fore-and-aft direction of the exterior-side plate 65 shown in FIG. 8, which is one of the plate-shaped members of the accommodation pocket 60, can be 20 cm at the maximum. The height H1 of the front-side plate 66 of FIG. 8 can be dimensioned from 5 to 15 cm. The height H2 of the rear-side plate 67 of FIG. 8 can be dimensioned from 3 to 15 cm. The width W from the interior-side plate 64 to the exterior-side plate 65 shown in FIG. 6 can be dimensioned from 5 to 7 cm.

(Pocket Front Portion 61)

The accommodation pocket 60 has pocket front and rear portion 61 and 62 as shown in the perspective view of FIG. 6. The pocket front portion 61 is arranged above the upper part of the driving wheel 3. The pocket rear portion 62 extends rearward from the pocket front portion 61. The bottom plate 68 has a bottom plate front part 68*a* and a bottom plate rear part 68*b* which can be defined by the pocket front portion 61 and the pocket rear portion 62. In the pocket front portion 61 shown in FIG. 6, the bottom plate front part 68*a*, which is the front part of the bottom plate 68, has a plate shape which extends in the horizontal direction. According to this arrangement, the pocket front portion 61 has a roughly rectangular parallelepiped shape, and the space above the upper part of the driving wheel 3 can be effectively used.

(Pocket Rear Portion 62)

The bottom plate rear part 68*b* of the pocket rear portion 62, which is the rear portion of the bottom plate 68, has a curved surface that extends upward toward the rear end of the accommodation pocket 60 as shown in FIG. 6. The exterior-side plate 65 has a corresponding shape the bottom edge of which extends along the bottom plate rear part 68*b*. The bottom part of the pocket rear portion 62 has a curved surface that extends along the outer periphery of the driving wheel 3 so that the bottom part of the accommodation pocket 60 is arranged close to and partially overlaps the upper part of the driving wheel 3 as shown in FIG. 9. According to this arrangement, the space above the upper part of the driving wheel 3 can be used without interference between the accommodation pocket 60 and the driving wheel 3. Since the bottom plate 68 in the pocket rear portion 62 has the curved shape, the total capacity of the accommodation pocket 60 can be increased as compared with the case where the accommodation pocket rear portion 62 is not provided and the bottom plate only has a flat shape. Also, since the pocket rear portion 62 of the accommodation pocket 60 covers the upper part of the driving wheel 3, the accommodation pocket 60 can serve as a tire cover which effectively prevents users' arms or sleeves from contacting the driving wheel 3. Accordingly, it is possible to keep the user from being soiled when the user uses the wheelchair. In this wheelchair, in the case where the gap between the driving wheel 3 and the accommodation pocket 60 is small, the accommodation pocket 60 can more effectively work as a tire cover. However, the shape of the bottom plate rear part in the pocket rear portion is not limited to a curved shape. The bottom plate in the pocket rear portion may be an inclined flat surface, or the bottom plate may be formed in a stepped shape, or the like as long as the bottom plate does not interference with the driving wheel 3. Alternatively, the bottom plate may have flat surfaces which have one or more intersections. In the case where the bottom plate in the pocket rear portion is an inclined flat surface, or the bottom plate is formed in a stepped shape, the accommodation pocket can be defined by flat surfaces. For this reason, the accommodation pocket can be easily manufactured. If the rear end of the accommodation pocket is positioned on the rear side relative to the vertical line that passes through the center of the driving wheel, the rear end part of the accommodation pocket can also be lowered toward the rear end of the accommodation pocket as long as the rear end part of the accommodation pocket does not interfere with the driving wheel.

(Drain Hole 78)

The accommodation pocket 60 has a drain hole 78, which is formed in the bottom plate front part 68*a* in the pocket front portion 61, as shown in FIG. 6. Even if liquid such as water, grains such as sand, and the like come into the accommodation pocket 60, the liquid, grains, and the like can be easily drained through the drain hole 78 from the accommodation pocket 60 without leaning the wheelchair or detaching the accommodation pocket 60. Since the bottom plate rear part 68*b* of the pocket rear portion 62 of the accommodation pocket 60 shown in FIG. 6 extends upwards along the curved shape, the liquid, grains, and the like in the accommodation pocket 60 can be automatically drained through the drain hole 78, which is arranged in the lower position.

(Panel 69)

The wheelchair includes plate-shaped panels 69 which face the side frames 1. The panel 69 is coupled to the side frame 1, and closes a part of space between the elbow rest frame portion 12 and the middle frame portion 15 as shown in FIG. 9. The accommodation pocket 60 is coupled to the side surface of the panel 69 which faces outward from the wheelchair. Since the panels 69 are attached to the side frames, the user can be prevented from unintended contact with the driving wheel 3 through opened space between the frame portions of the side frame 1 when sitting down in the seat space. In the case where the panel 69 is fastened to the side frame 1, the accommodation pocket 60 can be easily attached to the wheelchair. In the wheelchair shown in FIGS. 6 and 9, the accommodation pocket 60 is coupled to and lies in the surface of the panel 69 so that the interior-side plate 64 of the accommodation pocket 60 serves as a part of the panel 69. That is, the panel 69 and the interior-side plate 64 are integrally formed with each other. Since the panel 69 and the interior-side plate 64 are integrally formed with each other, the thickness of the interior-side plate 64 can be reduced or eliminated. Correspondingly, the capacity of the accommodation pocket 60 can be increased by the reduced or eliminated thickness. Although the panel 69 shown in FIG. 6 does not protrude upward from the opening 63, the panel may be arranged on the upper side relative to the opening 63. In the case where the panel extends higher than the opening 63 so that the panel completely closes the space between the elbow rest frame portion 12 and the middle frame portions 15, it is possible to prevent user's clothes, and the like from being caught by the driving wheel 3 when sitting on a seat 5.

(Panel Coupling Portion)

Figure 10:
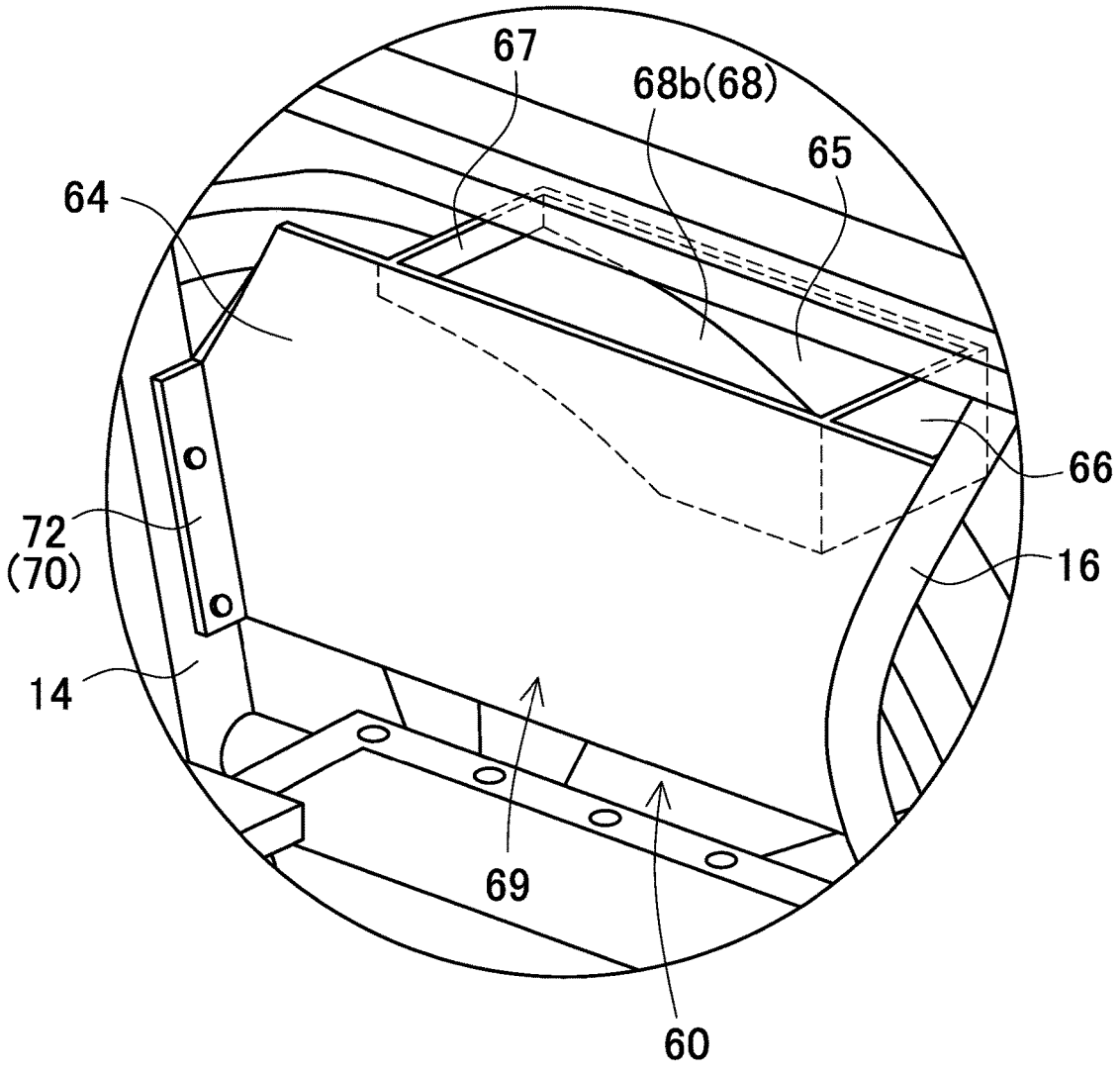
FIG. 10 is a perspective view of the accommodation pocket as viewed from the interior side of the wheelchair, which is opposite side to the view point in FIG. 9.

The panel 69 includes an panel coupling portion which is coupled to the side frame 1. The panel 69 shown in FIGS. 6 and 7 includes lateral coupling parts 70 as panel coupling portions which extend perpendicularly to the panel 69 from the front and rear ends of the panel 69 whereby forming an L shape in the front and rear end parts of the panel 69. A front-side lateral coupling part 71 is provided as the lateral coupling part 70. The front-side lateral coupling part 71 protrudes from the front end of the panel 69 roughly perpendicularly to the panel 69, more specifically, outward from the wheelchair. Also, as shown in FIG. 7, a rear-side lateral coupling part 72 is provided as the lateral coupling part 70. The rear-side lateral coupling part 72 protrudes from the rear end of the panel 69 roughly perpendicularly to the panel 69, more specifically, inward from the wheelchair. The lateral coupling part 70 has holes. Fasteners such as screws or rivets pass through the holes, and fasten the panel 69 to the side frame 1. The front-side lateral coupling part 71 contacts the interlinking frame portion 16, and is fastened to a part of the surface of the interlinking frame portion 16 which is perpendicular to the side frame as shown in FIG. 9. FIG. 10 is a perspective view of the accommodation pocket 60, which is fastened to the side frame 1, as viewed from the interior side of the wheelchair, which is opposite side to the view point in FIG. 9. Also, the rear-side lateral coupling part 72 contacts the vertical frame portion 14, and is fastened to a part of the surface of the vertical frame portion which is perpendicular to the side frame as shown in FIG. 10. Since the lateral coupling parts 70 are arranged in planes perpendicular to the side frame 1, the accommodation pocket 60 is partially positioned immediately under the elbow rest frame portion 12 so that the space immediately under the elbow rest frame portion 12 can be more effectively used. As a result, the capacity of the accommodation pocket 60 can be maximized. Since the lateral coupling parts are arranged at positions in the fore-and-aft direction of the panel 69, in other words, at positions which are opposed to each other, the panel 69 can be stably fastened. When fastened to the side frame 1, the panel 69 can be easily positioned by bringing the lateral coupling parts 70 into contact with the side frame 1. As a result, the panel 69 can be easily fastened to the side frame 1. Also, since the lateral coupling parts 70 extend roughly perpendicularly to the panel 69, the mechanical strength of the panel 69 can be improved.

It is preferable that the panel coupling parts extend in opposite directions relative to the panel 69 from the panel 69 as shown by the front-side and rear-side lateral coupling parts 71 shown in FIG. 6. According to this arrangement, even in the case where the vertical frame portion 14 and the interlinking frame portion 16 extend along different roughly vertical lines at different horizontal positions as viewed in the front view of the wheelchair of FIG. 3, the panel 69 can be fastened to the side frame 1 parallel to the vertical plane of the side frame 1.

(Front-Side Lateral Coupling Part 71)

The front-side lateral coupling part 71 has a curved form which bulges rearward in its central part. The reason is that the interlinking frame portion 16 of the wheelchair shown in FIG. 1 has a curved form which bulges rearward in its central part so that the footrest plate accommodation space 18 is provided between the elbow rest frame portion 12 and the middle frame portion 15, and serves as space for accommodating the footrest plate 42. Since the front-side lateral coupling part 71 also has a curved form which bulges rearward in its central part similar to the interlinking frame portion 16, the shape of the front-side lateral coupling part 71 fits with the interlinking frame portion 16. In the case where the interlinking frame portion 16 does not have such a curved form, that is, the footrest plate accommodation space 18 is not provided, the front-side lateral coupling part 71 does not has such a curved form which bulges rearward in its central part and may have a straight form.

(Rear-Side Lateral Coupling Part 72)

Since the rear-side lateral coupling part 72 contacts the vertical frame portion 14, it has a straight form as shown in FIG. 10. If the vertical frame portion 14 is curved so that such a straight form cannot fit with the vertical frame portion 14, the rear-side lateral coupling part 72 can have a curved form which fits with the vertical frame portion 14.

(Longitudinal Coupling Part 73)

The panel 69 shown in FIG. 6 includes a longitudinal coupling part 73 which is arranged the top of the front-side lateral coupling part 71, and protrude perpendicularly to the front-side lateral coupling part 71, more specifically frontward. The longitudinal coupling part 73 also has a hole similar to the lateral coupling part 70. A fastener can pass through the hole, and fasten the panel 69 to the side frame 1. Since the longitudinal coupling part 73 is provided, in addition to a surface of the interlinking frame portion 16 perpendicular to the side frame, the panel 69 can be fastened to in the exterior-side surface of the interlinking frame portion 16. As a result, the panel 69 can be more firmly fastened to the interlinking frame portion 16. Also, even in the case where the front-side plate 66 and the front-side lateral coupling part 71 are not spaced at a sufficiently gap away from each other, when it is difficult to place a fastener, which is used to fasten the panel 69 to the interlinking frame portion 16, into the gap between the front-side plate 66 and the front-side lateral coupling part 71, the panel 69 can be fastened through the longitudinal coupling part 73 to the interlinking frame portion 16. However, the longitudinal coupling part 73 is not necessarily provided, and may be omitted if the panel 69 can be sufficiently firmly fastened by the lateral coupling part 70 to the interlinking frame portion 16. Although the panel 69 shown in FIG. 6 includes only one longitudinal coupling part 73, the panel may include two or more longitudinal coupling parts 73. In this case, the panel can be more firmly fastened to the side frame. Also, the longitudinal coupling part 73 can be provided to the rear-side lateral coupling part 72, and fastened to the interior-side surface of the vertical frame portion 14.

(Modified Panel Coupling Portion)

The panel coupling portion is not limited to the foregoing embodiment. The lateral coupling parts may be omitted from the panel. Also, in this case, the panel coupling portions can be the holes through which the fasteners pass to fasten the panel to the frame. The end parts, and the like of the panel can be fastened to the frame by an adhesive or by welding instead of screws or rivets. The front-side and rear-side lateral coupling parts can protrude in the same direction from the main part of the panel. For example, in the case where the vertical frame portion of the wheelchair is positioned in the same vertical line as the interlinking frame portion as viewed in front view, when both the front-side and rear-side lateral coupling parts protrude outward, and the front-side lateral coupling parts 71 or the rear-side lateral coupling parts lie in the common plane of the interlinking frame portions or the vertical frame portions, the panels lie in opposed planes of the side frames which are located on the interior sides of the side frames, and the accommodation pockets are arranged further inside than opposed planes of the side frames which are located on the exterior sides of the side frames. Correspondingly, the capacity of the accommodation pocket can be increased by the width between the exterior side and the interior side of the side frame as compared with the case where the panel is coupled to the exterior sides of the side frame 1. The lateral coupling parts are not necessarily arranged on the front and rear sides of the panel. The lateral coupling part may be arranged on the upper or lower side of the panel. In this case, in addition to the vertical frame portion and the interlinking frame portion or alternatively, the panel can be fastened to a surface of the elbow rest frame portion or the middle frame portion which is perpendicular to the side frame. In the case where the lateral coupling part is arranged on the upper side of the panel, the lateral coupling part preferably protrudes inward so that the lateral coupling part does not overlap the opening of the accommodation pocket.

(Modified Accommodation Pocket)

A part of aforementioned accommodation pocket 60 can be also used as space for accommodating existing members of the wheelchair. For example, a part of the space of the accommodation pocket can accommodate a handbrake which can apply a frictional force for braking onto the outer peripheral part of the driving wheel. In this case, the conventional space for the brake can be eliminated. As a result, the wheelchair can be compact. Also, the accommodation pocket and other member constitute an auxiliary unit which includes a common fastening portion to be fastened to the side frame. In this case, the weight of the wheelchair can be reduced, and the fastening step can be simple.

Second Embodiment

The following description describes a wheelchair according to another, second embodiment of the present invention. In the accommodation pocket 60 according to the first embodiment, the front-side lateral coupling part 72 has been described which are arranged in front of the front-side plate 66 as shown in FIG. 6. However, the front-side plate can be arranged on the front end of the panel.

Figure 11:
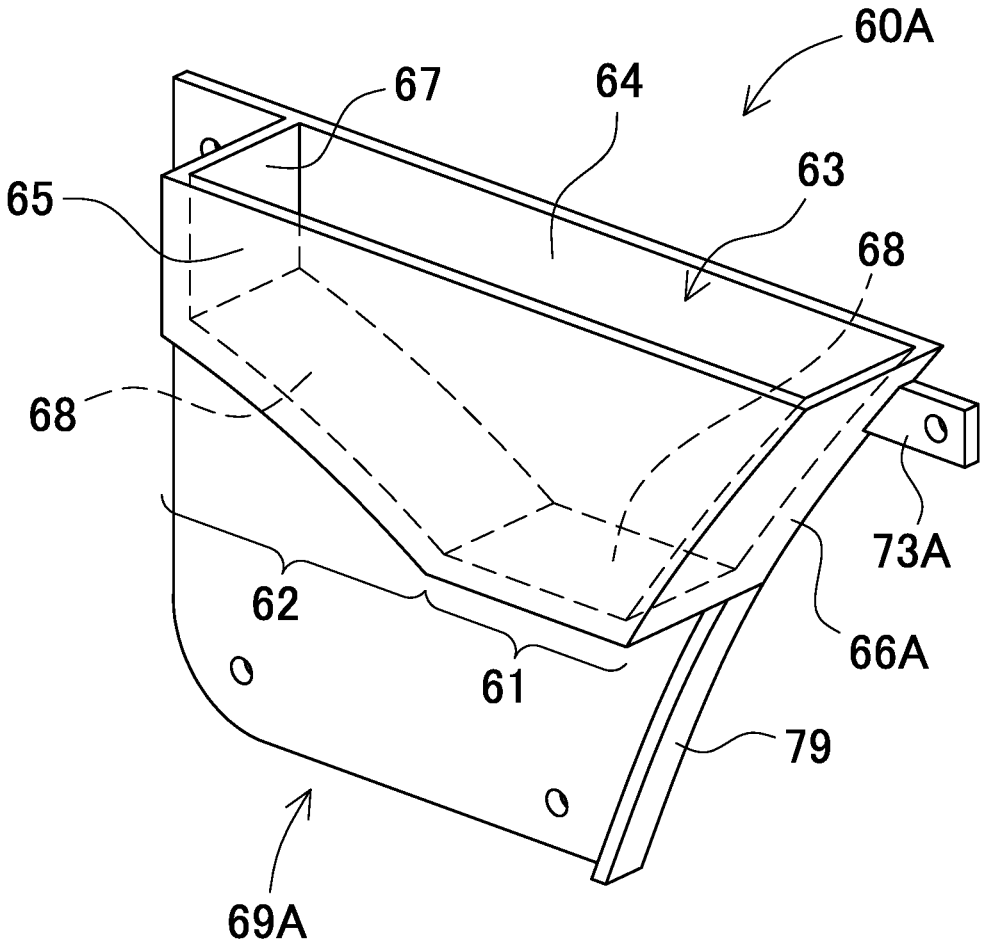
FIG. 11 is a perspective view of an accommodation pocket according to another embodiment of the present invention.

FIG. 11 is a perspective view showing an accommodation pocket 60A of the wheelchair according to the second embodiment. The accommodation pocket 60A is coupled onto the surface of a panel 69A. The accommodation pocket 60A of the wheelchair shown in FIG. 11 includes a front-side plate 66A which is arranged on the front end of the panel 69A. According to this arrangement, the space in the front part of the panel 69A can be effectively used for the accommodation pocket 60A so that the capacity of the accommodation pocket 60A can be increased.

(Panel 69A)

The panel 69A shown in FIG. 11 includes holes which are formed in the front and rear parts of the lower part, and the rear part of the upper part of the panel 69A. Fasteners can pass through the holes, and fasten the panel 69A to the side frame. The front and rear parts of the lower part of the panel 69A can be coupled to the exterior-side surface of the middle frame portion, and the rear part of the upper part of the panel 69A can be coupled to the exterior-side surface of the vertical frame portion.

(Lateral Part 79)

The panel 69A shown in FIG. 11 includes a lateral part 79 which protrudes outward roughly perpendicularly to the panel 69A whereby forming an L shape in the front end part of the panel 69A. The lateral part 79 is arranged on the front end of the panel 69A, and extends from the lower end of the accommodation pocket 60A to the lower end of the panel 69A. The strength of the panel 69A can be improved by the lateral part 79. Also, when coupled to the side frame, the panel 69A can be easily positioned with respect to the side frame by bringing the lateral part 79 in contact with the interlinking frame portion.

(Longitudinal Coupling Part 73A)

The panel 69A shown in FIG. 11 includes a longitudinal coupling part 73A which protrudes roughly perpendicularly to the front-side plate 66A. The longitudinal coupling part 73A can directly contact the interior-side surface of the interlinking frame portion, and can be fastened to the interlinking frame portion.

Third Embodiment

The following description describes a wheelchair according to another, third embodiment of the present invention. In the wheelchairs according to the first and second embodiments, the panel 69 and the accommodation pocket 60 have been described which are integrally formed with each other. However, the panel and the accommodation pocket can be separately formed from each other so that the accommodation pocket is detachable.

Figure 12:
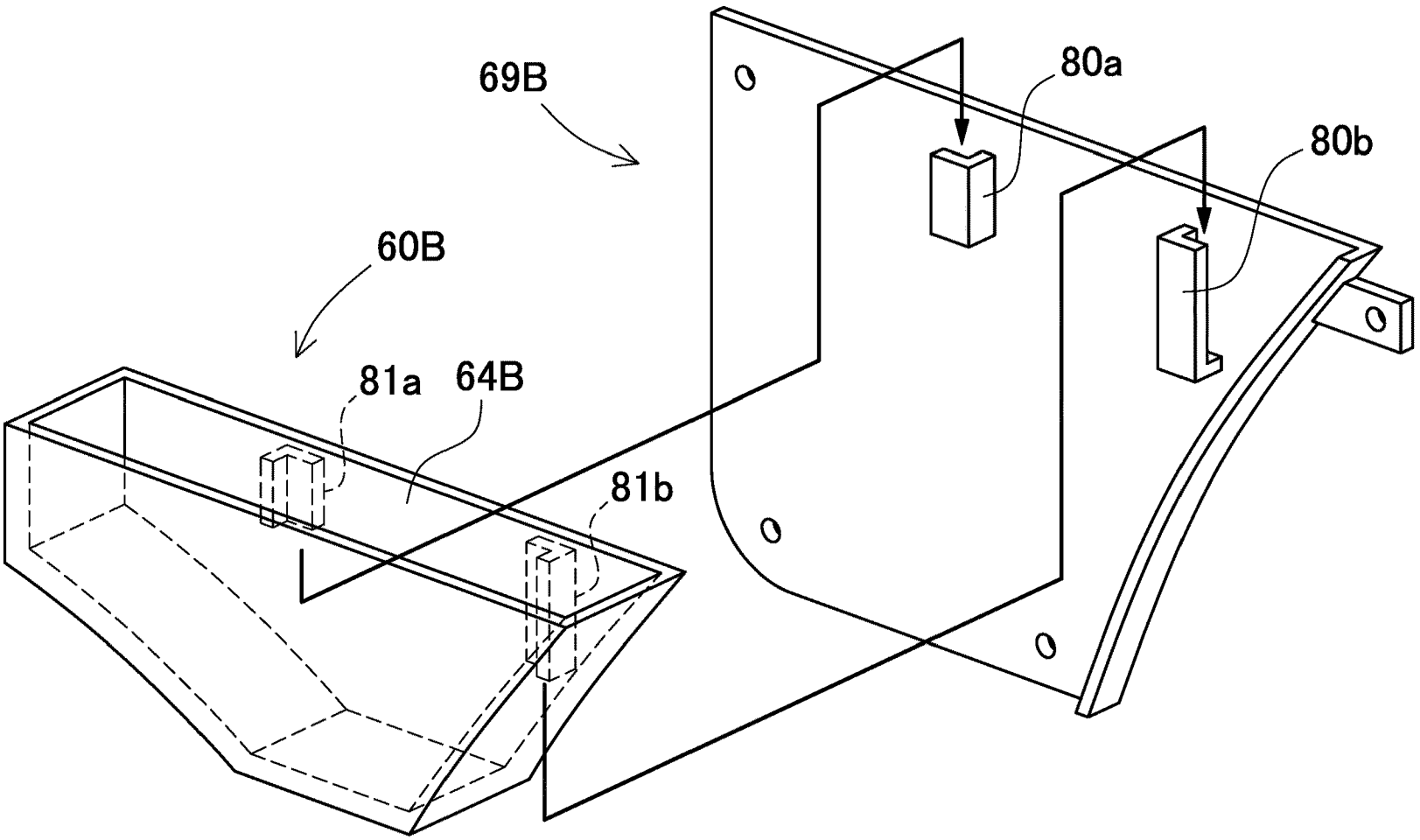
FIG. 12 is a perspective view of an accommodation pocket according to still another embodiment of the present invention.
Figure 13:
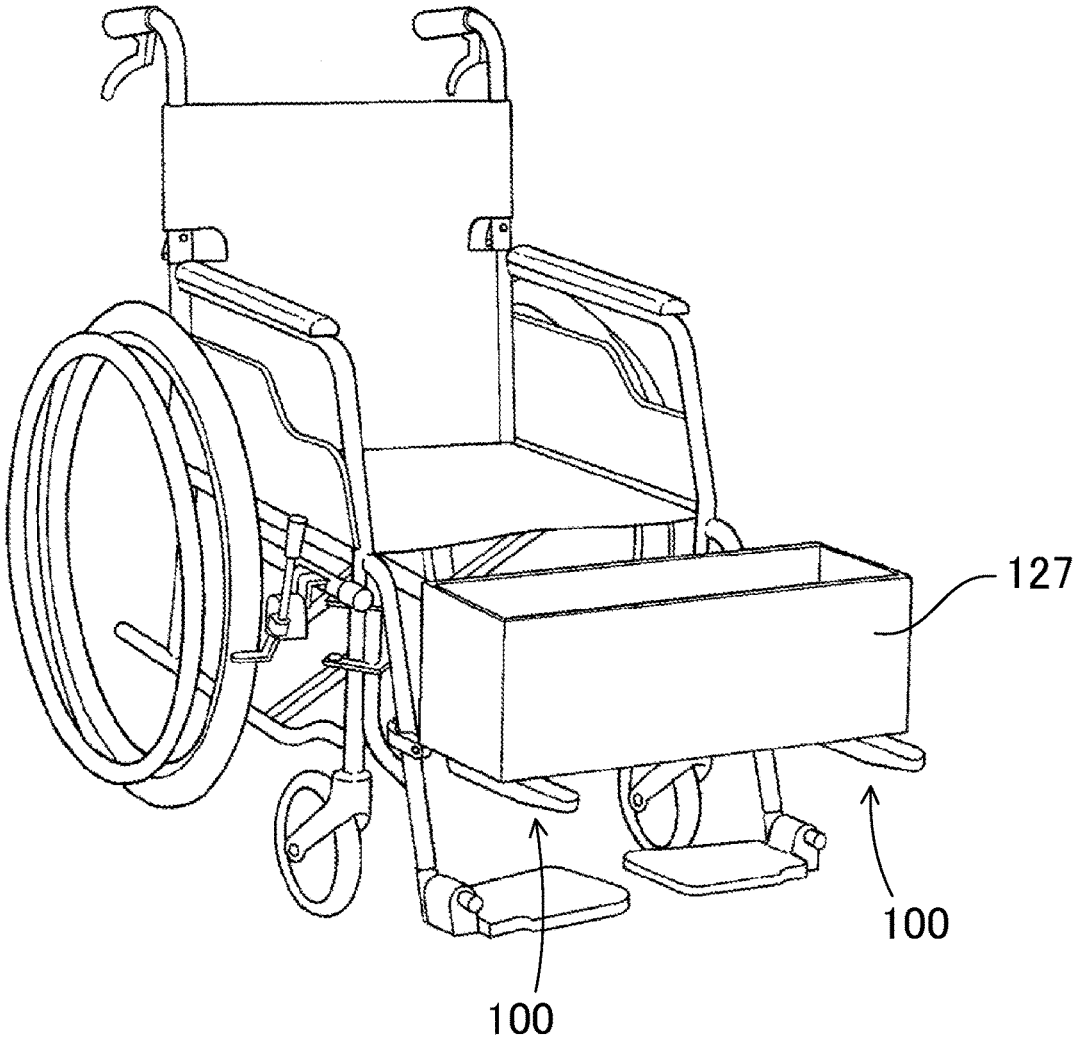
FIG. 13 RELATED ART
FIG. 13 is a perspective view showing a known wheelchair which is described in the related art and has baggage holders.

FIG. 12 is a perspective view showing an accommodation pocket 60B and a panel 69B of the wheelchair according to the third embodiment. The accommodation pocket 60B and the panel 69B shown in FIG. 12 include attachment portions which fit with each other. The accommodation pocket 60B is detachably attached to the panel 69B by the attachment portions.

The panel 69B shown in FIG. 12 includes the first attachment parts 80*a* and 80*b* on its surface which faces the accommodation pocket. The accommodation pocket 60B includes an interior-side plate 64B which faces the panel 69B. Second attachment parts 81*a* and 81*b* are arranged on the interior-side plate 64B at the positions corresponding to the first attachment parts 80*a* and 80*b*, and have shapes which allow detachable attachment to the first attachment parts 80*a* and 80*b*. The panel 69B and the accommodation pocket 60B shown in FIG. 12 can be easily coupled to each other by engagement between the first attachment parts 80*a* and 80*b*, and the second attachment parts 81*a* and 81*b*. When the accommodation pockets 60B are not used, the accommodation pockets 60B can be easily detached from the panels 69B while the panels 69B remain fastened to the side frame. It is noted that the first attachment parts 80*a* and 80*b*, and the second attachment parts 81*a* and 81*b* are illustratively shown in FIG. 12, and the detachable attachment is not limited to the aforementioned structure. Other ways can be used for the detachable attachment. For example, the accommodation pocket may be removably coupled to the panel by screws, and the like. The number of the engagement parts between the accommodation pocket and the panel is not limited to two, but can be one, or three or more. The second attachment part is not necessarily arranged on the interior-side plate 64B of the accommodation pocket 60B but can be arranged on other parts such as the front-side and rear-side plates of the accommodation pocket 60B.

The panels 69B and 69A according to the second and third embodiments shown in FIGS. 11 and 12 have holes in the main part of the panel so that fasteners can pass through the hole to fasten the panel to the side frame. Needless to say, the hole can be arranged in the lateral coupling part similar to the panel 69 according to the first embodiment shown in FIG. 6.

The wheelchairs according to the first to third embodiments have been described. However, the wheelchair according to the present invention is not limited to these embodiments. The accommodation pocket for wheelchairs according to the present invention can be used for known wheelchairs. The modified embodiment which has been described in the first embodiment can be also applied to the second and third embodiments.

Although the accommodation pockets for wheelchairs according to the first to third embodiments have been described which are entirely formed of plates, these are merely illustrations of an accommodation pocket to give a concrete form to technical ideas of the invention. The accommodation pocket of the present invention is not necessarily formed of plates. For example, the accommodation pocket can be formed of plates with a number of small apertures, or of net material. In this case, the weight of the accommodation pocket can be reduced. Also, the contact area between the accommodation pocket and articles can be reduced to increase a frictional force between them so that the articles do not slide inside the accommodation pocket. Alternatively, the accommodation pocket can be formed of a rigid frame and flexible members that are arranged over the openings of the frame. In this case, the accommodation pocket can be more lightweight. These features can be applied to the entire of or a part of the accommodation pocket.

According to the wheelchair of the present invention, since the accommodation pocket is accessible to the user while setting down, the user can easily put user's things into the accommodation pocket and pick up them. In addition, the accommodation pocket can serve as a tire cover, and keep user's arms and sleeves from being soiled by the driving wheels. Therefore, the user can be keep clean in used of the wheelchair.

Obviously, numerous modifications and variations of the present invention are possible in light of the above teachings. It is therefore to be understood that within the scope of the appended claims, the invention may be practiced otherwise than as specifically described herein.

What is claimed is:

1. A wheelchair comprising:

driving wheels;

a pair of side frames that rotatably support the driving wheels coupled to exterior sides of the side frames, each of the side frames including an elbow rest frame portion that has an elbow rest, a vertical frame portion that is coupled to a rear end part of the elbow rest frame portion, a lower frame portion that is arranged under the elbow rest frame portion, the vertical frame portion being coupled to a rear end part of the lower frame portion, and a middle frame portion that is positioned between the elbow rest frame portion and the lower frame portion, the vertical frame portion being coupled to a rear end of the middle frame portion; and an accommodation pocket that is arranged above the front part of one of the driving wheels as viewed in side view, and is at least partially positioned on an exterior side relative to the elbow rest frame portion as viewed in front view, and grip rings that are arranged on exterior surfaces of the driving wheels, wherein the whole accommodation pocket is arranged between the elbow rest frame portion and the middle frame portion, and wherein the accommodation pocket has an exterior-side plate, which is a plate-shaped material and defines the exterior side of the accommodation pocket, and the exterior-side plate is arranged on the interior side relative to the grip ring.

2. The wheelchair according to claim 1, wherein the accommodation pocket is at least partially arranged immediately under the elbow rest frame portion.

3. The wheelchair according to claim 2, wherein the accommodation pocket is arranged on the exterior side relative to the point of one of the right and left elbow rest frame portions which is closest to another elbow rest frame portion.

4. The wheelchair according to claim 3, further comprising a foldable link that couples the side frames to each other, and can guide the translational movement of the side frames approaching each other when the wheelchair is collapsed.

5. The wheelchair according to claim 1, wherein the accommodation pocket includes a pocket front portion that defines the front part of the accommodation pocket, a pocket rear portion that is located on the rear side relative to the pocket front portion, and a bottom plate that closes the bottom side of the accommodation pocket, wherein the bottom plate has a curved surface in the pocket rear portion that extends along the outer periphery of the driving wheel so that the accommodation pocket is arranged close to and at least partially overlaps the upper part of the driving wheel.

6. The wheelchair according to claim 5, wherein the pocket front portion has a roughly rectangular parallelepiped shape.

7. The wheelchair according to claim 1, further comprising a panel that at least partially closes the gap between the elbow rest frame portion and the middle frame portion, wherein the accommodation pocket is coupled to the panel.

8. The wheelchair according to claim 7, wherein the accommodation pocket is formed of a plate-shaped material, wherein the accommodation pocket has an interior-side plate, which is the plate-shaped material and defines the interior side of the accommodation pocket, and the interior-side plate is integrally formed with the panel.

9. The wheelchair according to claim 7, wherein the panel includes a panel coupling portion which is coupled to the side frame, wherein the panel coupling portion includes a lateral coupling part that extends perpendicularly to the panel toward the interior or exterior side of the wheelchair from an end of the panel thereby forming an L shape in the end of the panel.

10. The wheelchair according to claim 9, wherein the side frame further includes an interlinking frame portion that is coupled to end parts of the elbow rest frame portion and the middle frame portion which are opposite to their rear ends coupled to the vertical frame portion, wherein front-side and rear-side lateral coupling parts are provided as the lateral coupling part, wherein the front-side lateral coupling part is arranged on the front side of the panel, and is in contact with and fastened to the interlinking frame portion, and wherein the rear-side lateral coupling part is arranged on the rear side of the panel, and is in contact with and fastened to the vertical frame portion.

11. The wheelchair according to claim 10, wherein the vertical frame portion and the interlinking frame portion extend along different roughly vertical lines at different horizontal positions as viewed in front view, wherein said front-side and rear-side lateral coupling parts extend in opposite directions from the panel, wherein the panel extend parallel to the vertical plane of the side frame.

12. The wheelchair according to claim 11, wherein the panel coupling portion includes a longitudinal coupling part that extends in a fore-and-aft direction from the lateral coupling part, and is in contact with and fastened to the exterior or interior surface of the side frame.

13. A wheelchair comprising:

driving wheels;

a pair of side frames that rotatably support the driving wheels coupled to exterior sides of the side frames, each of the side frames including an elbow rest frame portion that has an elbow rest, a vertical frame portion that is coupled to a rear end part of the elbow rest frame portion, a lower frame portion that is arranged under the elbow rest frame portion, the vertical frame portion being coupled to a rear end part of the lower frame portion, and a middle frame portion that is positioned between the elbow rest frame portion and the lower frame portion, the vertical frame portion being coupled to a rear end of the middle frame portion;

an accommodation pocket that is arranged above the front part of one of the driving wheels as viewed in side view, and is at least partially positioned on an exterior side relative to the elbow rest frame portion as viewed in front view;

a panel that at least partially closes the gap between the elbow rest frame portion and the middle frame portion, wherein the accommodation pocket is coupled to the panel, and an attachment portion that can attach the accommodation pocket to the panel, wherein the whole accommodation pocket is arranged between the elbow rest frame portion and the middle frame portion, wherein the accommodation pocket is formed of a plate-shaped material, wherein the accommodation pocket has an interior-side plate, which is the plate-shaped material and defines the interior side of the accommodation pocket, and the interior-side plate is integrally formed with the panel, and wherein the attachment portion includes a first attachment part that is arranged on the panel, and a second attachment part that is arranged at the position of the accommodation pocket corresponding to the first attachment part, and has a shape for detachable attachment to the first attachment part so that the accommodation pocket can be detachably attached to the panel by the attachment portion.

14. A wheelchair comprising:

driving wheels, a pair of side frames that rotatably support the driving wheels coupled to exterior sides of the side frames, each of the side frames including an elbow rest frame portion that has an elbow rest, a vertical frame portion that is coupled to a rear end part of the elbow rest frame portion, a lower frame portion that is arranged under the elbow rest frame portion, the vertical frame portion being coupled to a rear end part of the lower frame portion, a middle frame portion that is positioned between the elbow rest frame portion and the lower frame portion, the vertical frame portion being coupled to a rear end of the middle frame portion, an accommodation pocket that is arranged above the front part of one of the driving wheels as viewed in side view, and is at least partially positioned on an exterior side relative to the elbow rest frame portion as viewed in front view, and wherein the side frame further includes an interlinking frame portion that is coupled to end parts of the elbow rest frame portion and the middle frame portion which are opposite to their rear ends coupled to the vertical frame portion, wherein the wheelchair further comprises footrest arms that can pivot in a fore-and-aft direction between a forward position where the fore ends are positioned on the front side relative to the side frames and a rearward position where their fore ends are positioned between the middle frame portion and the elbow rest frame portion, their rear end parts being pivotably coupled to the exterior surfaces of the front part of the side frames, and footrest plates that are pivotably coupled to the fore end parts of the footrest arms, the footrest plates being pivotable between an unfolded position where the footrest plates can support a user's feet and a folded position where upper surfaces of the footrest plates face the footrest arms, wherein a footrest plate accommodation space is provided on the front side relative to the interlinking frame portion between the elbow rest frame portion and the middle frame portion, wherein the accommodation pocket is arranged on the rear side relative to the interlinking frame portion, which is opposite to the footrest plate accommodation space with respect to the interlinking frame portion.

* * * * *